United States Patent [19]

Dubuc

[11] Patent Number: 4,546,806

[45] Date of Patent: Oct. 15, 1985

[54] METHOD FOR TRIMMING THE EDGES OF A SHEET OF VENEER PERPENDICULARLY TO ITS GRAIN WHILE PREVENTING THIS SHEET FROM SPLITTING

[75] Inventor: Luc Dubuc, Nicolet-Sud, Canada

[73] Assignee: Placages Nicolet-Sud Inc., Nicolet-Sud, Canada

[21] Appl. No.: 594,028

[22] Filed: Mar. 27, 1984

[51] Int. Cl.[4] ..... B27F 7/00; B27L 5/02

[52] U.S. Cl. ..... 144/345; 144/353; 144/369; 156/304.3; 156/545

[58] Field of Search ..... 144/344, 345, 350, 369, 144/353; 156/302, 304.3, 545, 558, 559

[56] References Cited

U.S. PATENT DOCUMENTS

| | | | |
|---|---|---|---|
| 814,062 | 3/1906 | Mayhew . | |
| 838,089 | 12/1906 | Dennis . | |
| 1,744,203 | 1/1930 | Becker . | |
| 3,490,974 | 1/1970 | Jacobson . | |
| 3,560,308 | 2/1971 | Buck . | |
| 3,962,016 | 6/1976 | Alfter et al. | 156/304.3 |
| 4,042,440 | 8/1977 | Hasegawa et al. | 156/304.3 |
| 4,246,063 | 1/1981 | Gronebaum . | |
| 4,351,379 | 9/1982 | Hasegawa | 156/304.3 |
| 4,414,050 | 11/1983 | Bernath | 156/304.3 |

FOREIGN PATENT DOCUMENTS

| | | | |
|---|---|---|---|
| 2165850 | 8/1972 | Fed. Rep. of Germany | 156/304.3 |
| 10379 | 3/1980 | Japan | 156/304.3 |

*Primary Examiner*—W. D. Bray
*Attorney, Agent, or Firm*—Robic & Robic

[57] ABSTRACT

A method for trimming the edges of a sheet of veneer perpendicularly to its grain while preventing this sheet from splitting. In a first step, a strip of tape is applied onto the sheet of veneer close to each of its edges to be trimmed. In a second, subsequent step, the tape-reinforced edges of the sheet of veneer are trimmed by shearing, preferably using a pair of overlapping cutting discs positioned to produce the requested shearing action. A machine especially designed for carrying out this method is also disclosed.

10 Claims, 7 Drawing Figures

FIG. 6
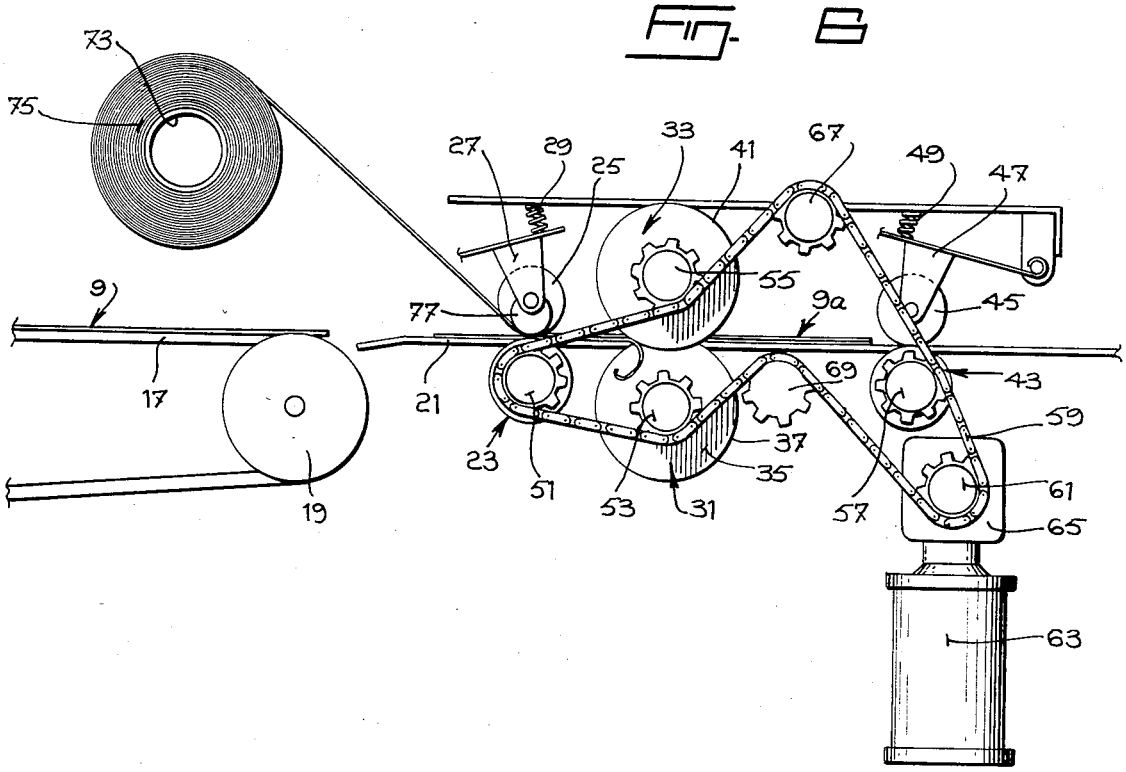
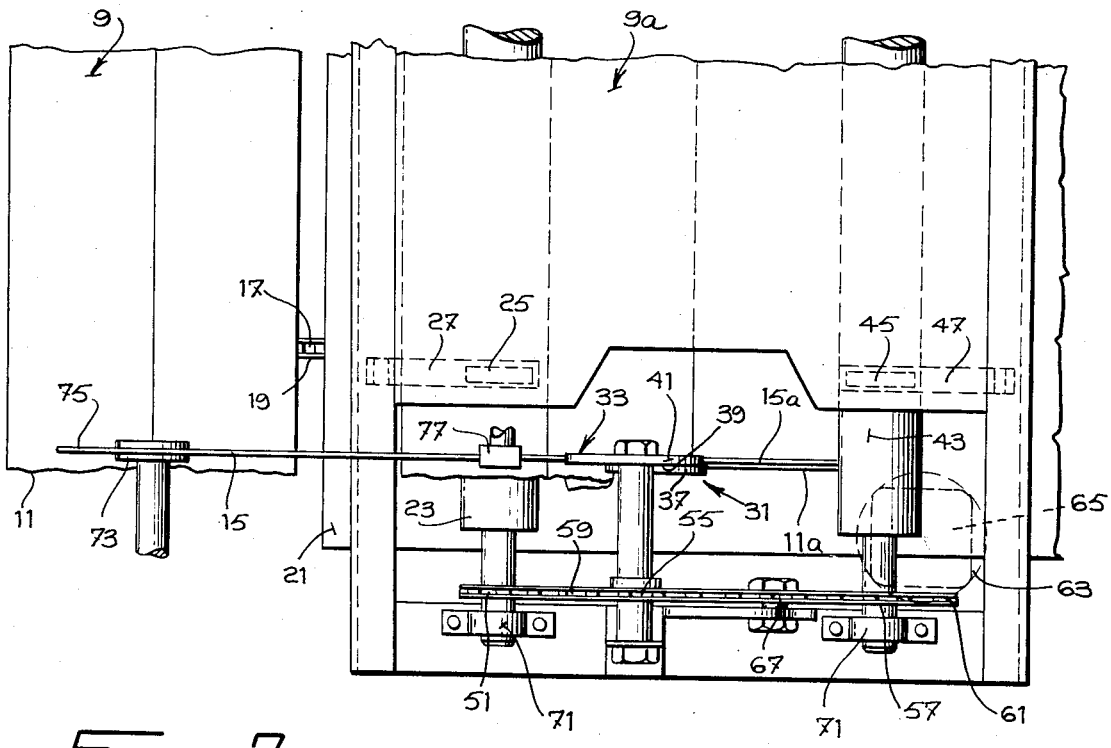
FIG. 7

METHOD FOR TRIMMING THE EDGES OF A SHEET OF VENEER PERPENDICULARLY TO ITS GRAIN WHILE PREVENTING THIS SHEET FROM SPLITTING

The present invention relates to a method for trimming the edges of a sheet of veneer perpendicularly to its grain while preventing this sheet from splitting.

The invention also relates to a machine especially designed for carrying out this method.

Methods and machines are already known and commonly used for forming a plurality of strips or pieces of veneer into sheets or ribbons which are thereafter cut into predetermined lengths that may subsequently be glued onto a sheet of plywood or any other substrate to finish it. The formation of the sheets or ribbons of veneer which is generally made by edge gluing the strips, is rather efficient and can be performed at relatively high speed with very few waste. A major problem is however encountered when trimming and/or cutting the so-formed sheets of veneer, and/or when subsequently manipulating them. This problem is the accidental breaking, tearing, scratching or cracking of the sheets which are usually very thin and subject to damages. Cracking which, in some cases, may extend completely across a sheet and break the same, is a major source of waste, since it generally degenerates into ungluing, blistering and/or overlapping of the veneer layer after it has been pressed and glued onto the surface of the substrate to be finished. For this reason, numerous sheets of veneer with cracks or tears are systematically rejected, thereby substantially increasing the manufacturer's cost, especially as veneer is, in most of the cases, made from good quality wood, such as oak or teak.

To overcome this problem, methods and machines have already been suggested, such as those disclosed in U.S. Pat. No. 1,744,203 of Jan. 21, 1983 or U.S. Pat. No. 3,560,308 of Feb. 2, 1971. The methods and machines disclosed in both of these patents are apparently efficient. However, they are exclusively designed for either confining the cracks that may form to a limited surface of the sheet of veneer, or to repair a sheet of veneer already cracked or torn. In other words, none of these patents discloses a method for actually preventing a sheet of veneer from splitting, cracking or tearing, especially during trimming of its edges perpendicularly to its grain or during cutting of this sheet into patches.

A first object of the present invention is to provide a method for trimming the edges of the sheet of veneer perpendicularly to its grain while preventing this sheet from splitting, which method is intended to obviate the above mentioned problem encountered in trimming or cutting sheets of veneer.

The method according to the invention comprises the steps of:

applying a strip of tape onto the sheet of veneer close to each of the edges to be trimmed, and subsequently trimming the edges by shear, preferably using a pair of overlapping cutting discs positioned to produce the requested shearing action.

Another object of the present invention is to provide a machine for carrying out the above-mentioned method. method.

The machine according to the invention comprises:

means for moving the sheet of veneer to be trimmed in a direction perpendicular to its grain;

means for applying a strip of tape onto the sheet of veneer close to each of its edges to be trimmed; and shearing means positioned behind the tape applying means, for trimming the tape-reinforced edges of said sheet of veneer as it moves through the machine.

In accordance with the invention, it has been discovered that the combination of a tape reinforcement of the edges of the sheet of veneer to be trimmed with the shearing action of a pair discs or of any other shearing means used for trimming the reinforced edges of the sheet of veneer, advantageously prevents the same from breaking, tearing or cracking, thereby reducing to a considerable extent the amount of waste generally encountered in the veneer industry. Of course, the tape reinforcement of the sheet of veneer continues to be effective after cutting or trimming has been carried out, when subsequently manipulating the sheet of veneer.

The invention will be better understood with reference to the following, non-restrictive description of a preferred embodiment thereof, taken in connection with the accompanying drawings wherein:

FIG. 6 is a side elevational view of the machine shown in FIG. 5; and

FIG. 7 is a top plan view of the mechanism shown in FIG. 6 for trimming one edge of the sheet of veneer processed in the machine, the mechanism used for processing the other edge of the same sheet being symmetrical with respect to the longitudinal axis of the machine.

Figure 1:
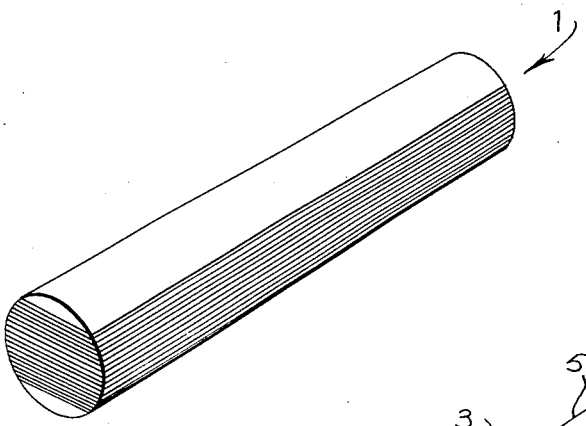
FIG. 1 (PRIOR ART)
FIGS. 1 to 3 show successive steps in the formation of a veneer sheet from a core of good quality wood.
Figure 2:
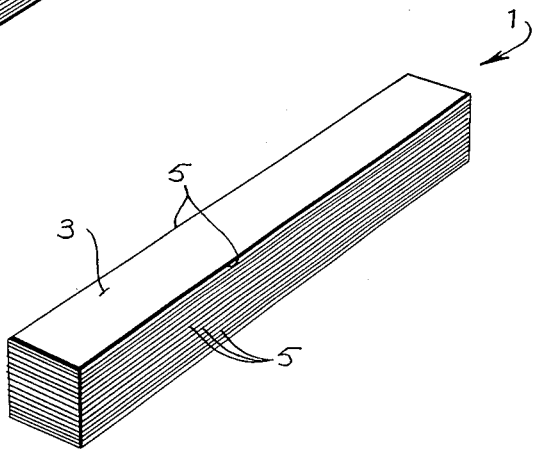
FIG. 2 (PRIOR ART)
Figure 3:
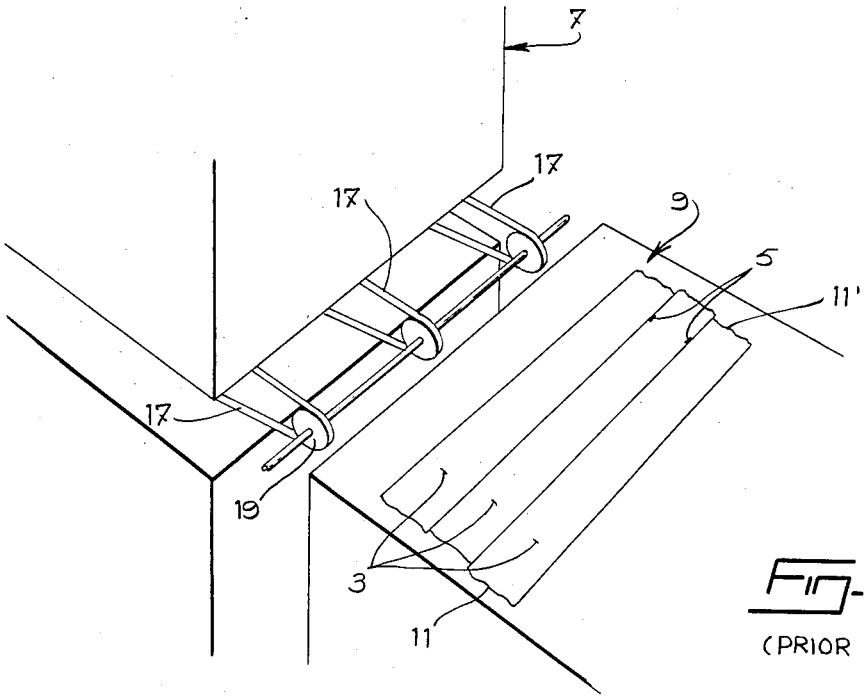
FIG. 3 (PRIOR ART)

As shown in FIGS. 1 to 3, the conventional method used for the fabrication of veneer basically consists in longitudinally slicing a piece or core 1 of good quality wood such as oak or teak (see FIG. 1), subsequently trimming the lateral sides of this sliced core 1 to obtain a plurality of elongated strips 3 of veneer identical in shape (see FIG. 2), and subsequently feeding the so fabricated strips of veneer into a forming machine 7 (see FIG. 3) wherein the strips are positioned crosswise of their path and glued to each other along their edges 5 to form a sheet 9 of undetermined length. The forming machine 7 and the edge gluing technology used therein are well known in the art and no invention is hereby claimed therefor.

Usually, the strips of veneers 3 glued edge-to-edge to form the sheet 9 of veneer have their respective ends either roughly trimmed or not exactly aligned with the ends of the adjacent strips. As a result, the edges 11 and 11' of the sheet of veneer 9 formed by all the strips 3 usually have to be trimmed before further processing and using the sheet 9.

Figure 5:
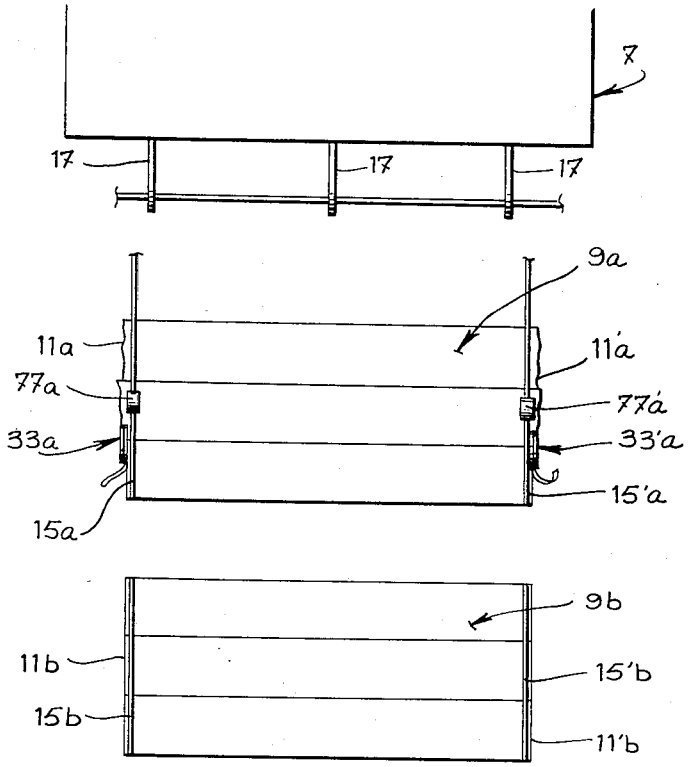
FIG. 5 is a schematic top elevational view of a machine according to the invention for trimming the edges of a sheet of veneer perpendicularly to its grain while preventing the same from splitting.
Figure 4:
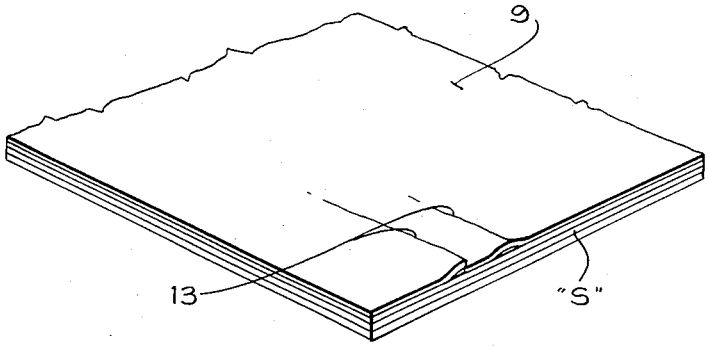
FIG. 4 (PRIOR ART)
FIG. 4 shows a problem that may be encountered when gluing a cracked sheet of veneer onto a substrate.

The machine according to the invention as shown in FIGS. 5 to 7 is intended to be used just behind or as an attachment to the forming machine 7, for immediately trimming the edges of the sheets of veneer 9 getting out of the forming machine 7, while preventing these sheets 9 from splitting, cracking or tearing. Indeed, any tear, crack occurring during such a trimming may substantially reduce the quality of the sheets of veneer produced by the machine, the presence of cracks 13 in the veneer sheets 9 being generally source of defaults (blisters, overlapping, tearing) when the veneer is pressed and glued onto a substrate S that may be a sheet of plywood or any other material (see FIG. 4).

The machine according to the invention comprises means for applying strips of tape 15 and 15' onto the sheet of veneer 9 close to its edges 11 and 11' respectively, to reinforce the same before they are trimmed by shear using a pair of overlapping cutting discs 31 and 33 positioned on both side of the machine to produce the requested shearing action onto each edge.

Since the tape applying and shearing means on both sides of the machine are symmetrical and act in a synchronized manner on both edges 11 and 11', only the means used for trimming the edge 11 will be described hereinafter.

It should be noted that, in FIGS. 5 to 7, different sheets of veneer shown at different positions in the machine have been distinguished from each other by using different litteral subscripts. Since all these sheets are otherwise identical, no particular reference shall be made to these subscripts as used in the drawings, except for the purpose of clarification if necessary.

As shown on FIGS. 6 and 7, the machine for trimming the edges of the sheet of veneer 9 comprises a support table 21 positioned to receive the sheet of veneer 9 pushed out of the forming machine 7 by a plurality of conveyer belts 17 rotating over a set of reversing rollers 19.

Means are provided in the machine for moving the sheets of veneer 9 to be trimmed in a direction perpendicular to their grain, that is in a direction perpendicular to the longitudinal axes of the strips used for their manufacture. These means for moving the sheets of veneer 9 to be trimmed comprises a first feed roller 23 extending tangentially in a recess provided into the table 21 so as to engage the bottom surface of each sheet 9 pushed into the machine. A pressure roller 25 is provided for pressing the sheet 9 of veneer again the feed roller 23. The pressure roller 25 is positioned over the table 21 so as to press onto the upper surface of the sheet of veneer 9 just over the surface of the roller 23. The pressure roller 25 is mounted on a pivoting support 27 and is pushed toward the roller 23 by a spring 29. The pressure roller 25 and feed roller 23 together define an adjustable nip in which may engage the sheets of veneer 9 to be trimmed.

The cutting discs 31 and 33 used for trimming the edge 11 of the sheet 9 of veneer by shear are positioned a few inches behind the feed roller 23. The cutting discs 33 and 35 have their respective axes positioned above and under the support table 21 along which moves the sheet 9 to be trimmed. The cutting disc 31 has at least one flat face 35 define a sharp corner with its peripheric 37. The disc 33 also has one flat face 39 defining a sharp corner with its periphery 41. The discs are positioned so that their flat faces 35 and 39 be adjacent and slightly overlapping, as shown in FIG. 6. The discs 31 and 33 are positioned at equal distance from the surface 21 so that the sheets 9 to be trimmed is fed in the middle of their overlapping zone in a direction perpendicular to the plane in which extends the axes of both discs. In other words, the discs 31 and 33 are positioned symmetrically up and down the support table 21.

In use, shearing is obtained by counterrotating the discs in the same direction as the one in which the sheet 9 of veneer to be trimmed is pushed through the disc overlapping zone.

In this connection, it should be noted that the use and operation of such a pair of discs as shearing means is already known in the art, and commonly used in industrial shredding machines. In particular, it is already known that the effectiveness of such a pair of discs increases with a decrease of the angle defined by the external periphery of both discs at the point where the sheet of veneer to be trimmed engages the overlapping zone. In turn, the magnitude of this angle is a function of the size of the overlap and the diameter of the discs. All of these parameters have of course to be selected according to the manufacturer's requirements, especially as a function of the thickness of the sheet of veneer 9 to be processed.

Another feed roller 43 is positioned behind the cutting discs 31 and 33 to help the feed roller 23 to move the sheet 9 between the discs 31 and 33 and to subsequently take over alone the motion of the sheet 9 when it leaves the feed roller 23. The feed roller 43 is identical in structure and operation to the feed roller 23. It also works in cooperative relationship with a pressure roller 45 mounted onto a pivoting support 47 downwardly biased by a spring 49. Structurally, this pressure roller is identical to the one previously described. For this reason, it will not be further elaborated.

Means are provided for rotating each of the feed rollers 23 and 43 to move the sheets 9 of veneer engaged in their respective nips and for counter rotating the discs 31 and 33 in the same direction as the one in which the sheet of veneer is moved through the disc overlapping zone. These means comprises a plurality of sprocket wheels 51, 53, 55 and 57 solidly mounted at the end of the shafts supporting the feed roller 23, the discs 31 and 33 and the feed roller 43, respectively. All these sprocket wheels are engaged by the same endless chain 59 which is itself driven by a sprocket 61 operated by a motor 63 via a right angle transmission and reduction box 65. To provide the necessary tension onto the chain and allow the same to rotate the feed rollers and cutting discs in their required directions, two or more guide rollers 67 and 69 may be provided, as shown in FIG. 6.

Of course, the shafts of the different elements driven by the chain 59 are to be rigidly mounted onto the frame of the machine in any common manner, using bearings 71 as shown in FIG. 7.

As aforesaid, means are provided in accordance with the invention for applying a strip of tape onto the sheet of veneer 9 close to the edge 11 of the sheet of veneer to be trimmed. These means for applying a strip of tape comprises a reel 73 supporting a roll 75 of pressure sensitive tape 15. These means also comprises a small roller 77 mounted in parallel relationship with respect to the pressure roller 25 cooperating with the feed roller 23 placed in front of the cutting discs 31 and 33. The small roller 77 which is mounted on the same support 23 as the pressure roller 25 is used for pressing and thus gluing the tape 15 unwinding from the roll 75 directly onto the sheet of veneer 9 as it is moved by the feed roller 23. As shown in FIG. 6, the small roller 77 is mounted above the feed roller 23 to glue by pressure the strip of tape 15 over the feed roller 23 to avoid any deformation of the sheet of veneer 9 that could otherwise occur.

Of course, it is compulsory that the strips of tape 15 and 15' be glued onto the edges 11 and 11' of the sheet 9 of veneer before these edges are trimmed by the discs 31 and 33. Accordingly, the tape applying means must always be positioned in front of the shearing means, as shown in FIGS. 6 and 7.

Tests carried out by the Applicant have proved that the above described machine is quite efficient in use and actually permits to trim sheets of veneer perpendicularly to their grain with very few waste.

Of course, many modifications and/variants can be brought to the method and machine described hereinabove, without abandoning the outline of the present invention as delimitated in the following claims.

The embodiments of the invention in which an exclusive property or privilege is claimed are defined as follows:

1. A method for trimming the edges of a sheet of veneer perpendicularly to its grain while preventing said sheet from splitting, said method comprising the steps of:

applying a strip of tape onto the sheet of veneer close to each of its edges to be trimmed, and subsequently trimming said edges by shear.

2. The method of claim 1, wherein the trimming step is carried out with a pair of overlapping cutting discs positioned to produce the requested shearing action.

3. A machine for trimming the edges of a sheet of veneer perpendicularly to its grain while preventing said sheet from splitting, said machine comprising:

means for moving the sheet of veneer to be trimmed in a direction perpendicular to its grain;

means for applying a strip of tape onto the sheet of veneer close to each of its edges to be trimmed; and shearing means positioned behind the tape applying means, for trimming the tape-reinforced edges of said sheet of veneer as it moves through the machine.

4. The machine of claim 3, wherein said shearing means comprises, for each of said edges to be trimmed:

two cutting discs each having an axis, a cylindrical periphery and at least one flat face defining a sharp corner together with said periphery, said discs having their axes parallel and their flat faces adjacent and overlapping, said axes being positioned above and under the plane in which moves the sheet to be trimmed in such a manner that said sheet is fed in the middle of the disc overlapping zone and moves through said discs in a direction perpendicular to the plane in which extend their axes; and means for counter rotating said discs in the same direction as the one in which the sheet of veneer moves through the disc overlapping zone.

5. The machine of claim 4, wherein both of said cutting discs have the same diameter.

6. The machine of claim 5, wherein said means for moving the sheet of veneer to be trimmed comprises:

at least one feed roller;

a pressure roller pressing against said at least one feed roller, said pressure and feed rollers providing a self-adjustable nip in which engages the sheet of veneer; and means for rotating said at least one feed roller to move the sheet of veneer engaged on its nip.

7. The machine of claim 6, wherein said means for moving the sheet of veneer comprises two feed rollers positioned in front of, and behind the cutting discs, respectively.

8. The machine of claim 7, wherein said means for counter rotating the discs and said means for rotating the feed rollers comprises:

sprocket wheels solid with the discs and rollers to be rotated;

an endless chain engaging all the sprockets adjacent one of said edges to be trimmed; and a single motor for simultaneously driving the endless chains, sprocket wheels, discs and rollers of the machine.

9. The machine of claim 8, wherein said means for applying a strip of tape comprises, for each of said edges to be trimmed:

a reel supporting a roll of pressure sensitive tape; and a small roller mounted in parallel relationship with respect to the pressure roller cooperating with the feed roller placed in front of the cutting discs, said small roller pressing against the feed roller in front of the cutting discs to fix the tape supplied from the reel onto the sheet of veneer as it is moved by said feed roller.

10. The machine of claim 9, further comprising a working table for supporting the central portion of the sheet of veneer while it is processed.

* * * * *